US006322204B1

(12) United States Patent
Blum et al.

(10) Patent No.: US 6,322,204 B1
(45) Date of Patent: Nov. 27, 2001

(54) RETAINING AND INSTALLING A PRINTHEAD IN A PRINTHEAD DOCKING STATION

(75) Inventors: John N. Blum, Kettering; Bruce A. Bowling, Beavercreek; Homer D. Durst, Springfield, all of OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/211,063

(22) Filed: Dec. 14, 1998

(51) Int. Cl.[7] ..... B41J 2/07; B41J 2/17

(52) U.S. Cl. ..... 347/74; 347/84

(58) Field of Search ..... 347/74, 75, 49, 347/50, 138, 152, 170, 222, 245, 263, 84; 400/279, 320; 346/139 R, 140.1; 101/216

(56) References Cited

U.S. PATENT DOCUMENTS 4,809,015 * 2/1989 Bowling et al. ..... 347/75
5,160,938 * 11/1992 Fargo et al. ..... 347/75
5,275,105 * 1/1994 Schweizer et al. ..... 101/216
5,500,664 * 3/1996 Suzuki et al. ..... 347/86

* cited by examiner

*Primary Examiner*—Thinh Nguyen
(74) *Attorney, Agent, or Firm*—Barbara Joan Haushalter

(57) ABSTRACT

In an ink jet printer having a printhead and a printhead docking station, an improvement is provided in installation and retention of the printhead in the printhead docking station. Straight line travel of the printhead relative to the printhead docking station is ensured using guide posts or other guiding mechanisms. Non-abrupt actuation, such as a screw drive actuator is used to translate the printhead relative to the docking station. The screw drive actuator is oriented at near right angles to the direction of translation of the printhead relative to the printhead docking station. The printhead and the printhead docking station are then aligned so that electrical and fluid connections can be made concurrently. During the installation, a consistent insertion force, such as a spring loaded toggle mechanism, is applied to the printhead, regardless of part tolerances.

8 Claims, 3 Drawing Sheets

RETAINING AND INSTALLING A PRINTHEAD IN A PRINTHEAD DOCKING STATION

TECHNICAL FIELD

The present invention relates to continuous ink jet printers and more particularly to installing and retaining in place the printhead in such printers.

BACKGROUND ART

In continuous ink jet printing, ink is supplied under pressure to a manifold that distributes the ink to a plurality of orifices, typically arranged in linear array(s). The ink is expelled from the orifices in jets which break up due to surface tension in the ink into droplet streams. Ink jet printing is accomplished with these droplet streams by selectively charging and deflecting some droplets from their normal trajectories. The deflected or undeflected droplets are caught and re-circulated and the others are allowed to impinge on a printing surface.

The printhead for a continuous ink jet printing apparatus is usually required to be replaced after a certain number of hours of use, typically as a result of failure, then returned to the manufacturer for refurbishing. Unfortunately, removing the printheads and, consequently, reinstalling printheads, is time consuming and subject to error.

For example, when the printhead on a one-inch printer is removed, it is necessary to first remove printer system covers, revealing all components of the controller and printhead, then disconnecting multiple electrical connections, fluid connections, and back-off fasteners retaining the printhead.

Similarly, on a four-inch printer, the printhead and controller are built as one unit and must be removed as a unit, necessarily involving disconnecting all electrical and fluid lines at the unit, then disconnecting two latches. The unit is then lifted away from its mount.

U.S. Pat. No. 4,809,015 discloses one method for accomplishing printhead installation and retainment. In the '015 patent, the means to support the printhead were located under the printhead. While that was acceptable for a drum printer, it is not appropriate for a printer which prints on a flat base where the support means would require a large print distance. The '015 patent utilized a over center cam latching action to secure the printhead. While the over center cam latch mechanism works appropriately for small printheads, when scaled to a much larger, heavier long array printhead such over center cam latches require much stronger bias springs. While the printhead is being secured by such a mechanism, as the latch passes the overcenter point, the needed strong springs tend to engage the printhead in the nesting hardware too abruptly. This can result in damage to the mating fluid and electrical connections. It can also pose a pinching or smashing hazard to the fingers of the operator. For these reasons the method of the '015 patent cannot be readily adapted for use with long array ink jet printer systems.

A need has therefore been identified for an easily replaceable printhead for use with various size printers.

SUMMARY OF THE INVENTION

It is the object of the present invention to provide a printhead installation and retaining mechanism for installing and retaining the printhead onto the printhead interface controller.

In accordance with one aspect of the present invention, separation of the printhead, which necessarily requires occasional refurbishing, and the printhead controls which typically require less repair and can be maintained without removal from the printer system, is taught. The present invention allows for proper positioning of the printhead on the controller while making the electrical, fluid, and mechanical connections upon installation of the printhead. The steps required to accomplish the concept of the present invention comprise sliding the printhead into approximate position, inserting a tool wrench into a socket, and rotating until the printhead is in position, which is approximately seven rotations.

Other objects and advantages of the invention will be apparent from the following description and the appended claims.

DETAILED DESCRIPTION OF THE INVENTION

Figure 1:
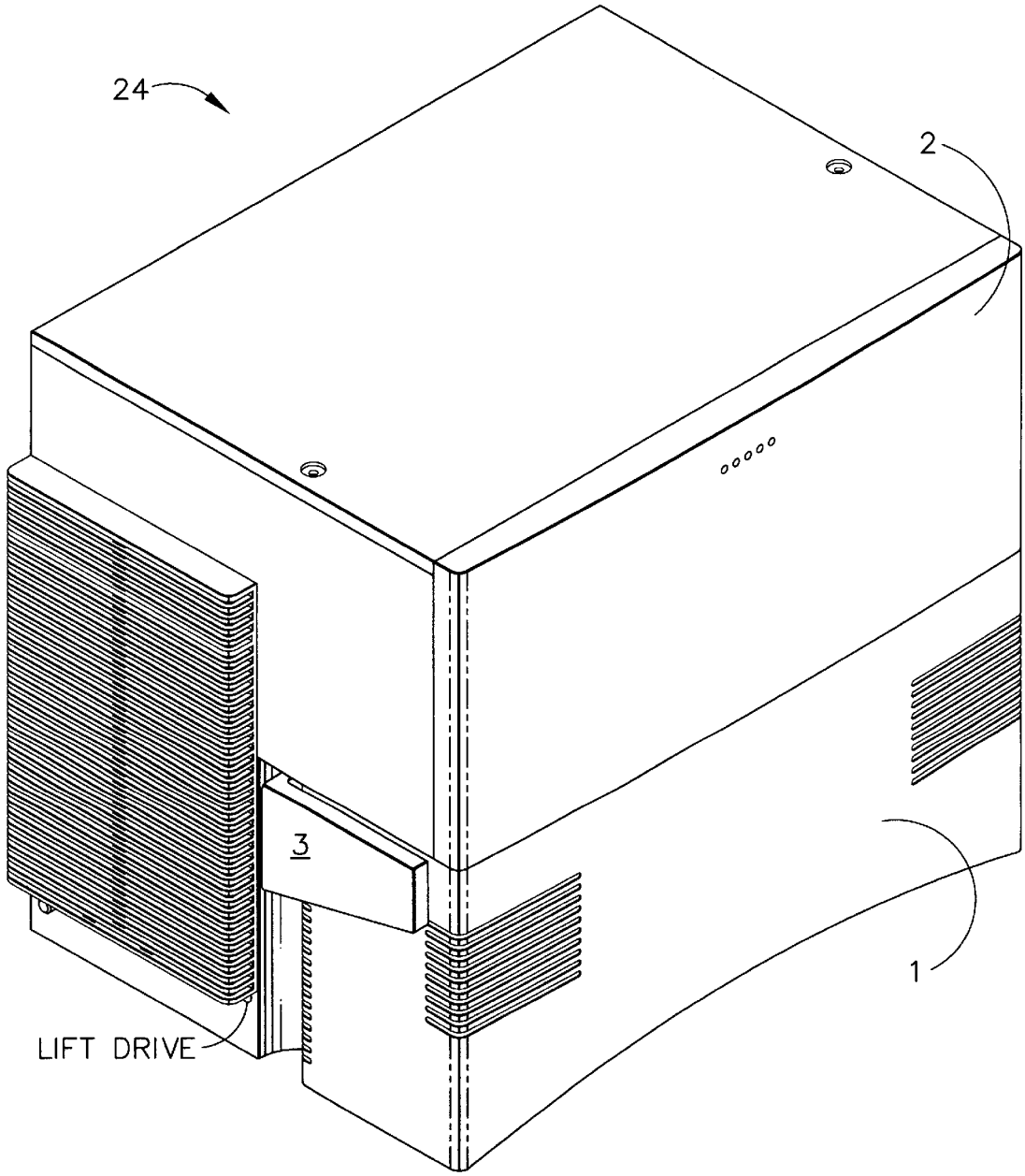
FIG. 1 is an isometric view showing the printhead engaged with the printhead interface controller and ready for operation.

Referring to the drawings, FIG. 1 illustrates two major assemblies generally designated as reference number 24, comprising a printhead 1 and a printhead interface controller or printhead docking station 2. A printhead lift mechanism 3 is a sub-assembly of the printhead interface controller 2. FIG. 1 illustrates the printhead 1 in an engaged position.

Figure 2:
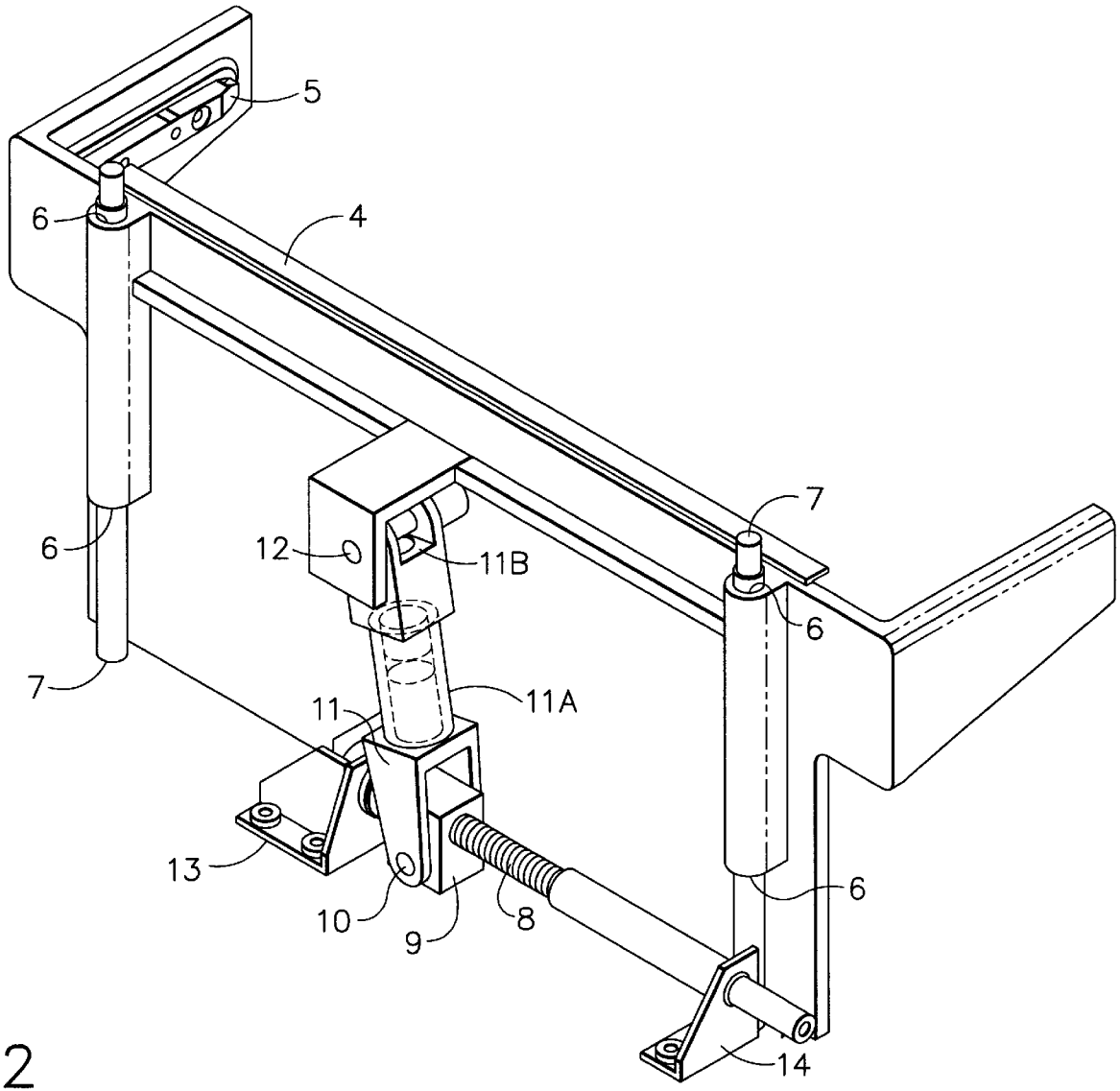
FIG. 2 is an isometric view showing one embodiment of the printhead lift mechanism according to the present invention.

Continuing with FIG. 1 and referring also to FIG. 2, to engage or lift the printhead into place the lift mechanism 3 must be in the down position. The lift mechanism 3 of the printhead interface controller 2 has parallel dovetails 5 at either end of the mechanism 3. The printhead 1 can be slid onto the dovetails, contacting a stop 22, approximately positioning the printhead horizontally. The lift mechanism is raised and lowered by a drive screw mechanism which will be described in more detail later. As the lift. mechanism is raised, it lifts the printhead in a smooth and straight line movement and causes it to engage two guide pins 15. The printhead held by the dovetails of the lift mechanism can shift around freely so that it can be aligned with more precision by the guide pins. Therefore, the engagement with the guide pins provides the alignment needed to engage five fluid fittings 16 and one 352 pin electrical connector 17A and 17B, consecutively.

Conversely, to disengage the printhead for removal, the lift mechanism is lowered by means of the drive screw mechanism 8. The smooth, straight line motion provided by the lift mechanism disengages the fluid fittings and the electrical connections simultaneously without risk to the connections. With the printhead lowered the printhead can be easily slid off the dovetails.

Figure 3:
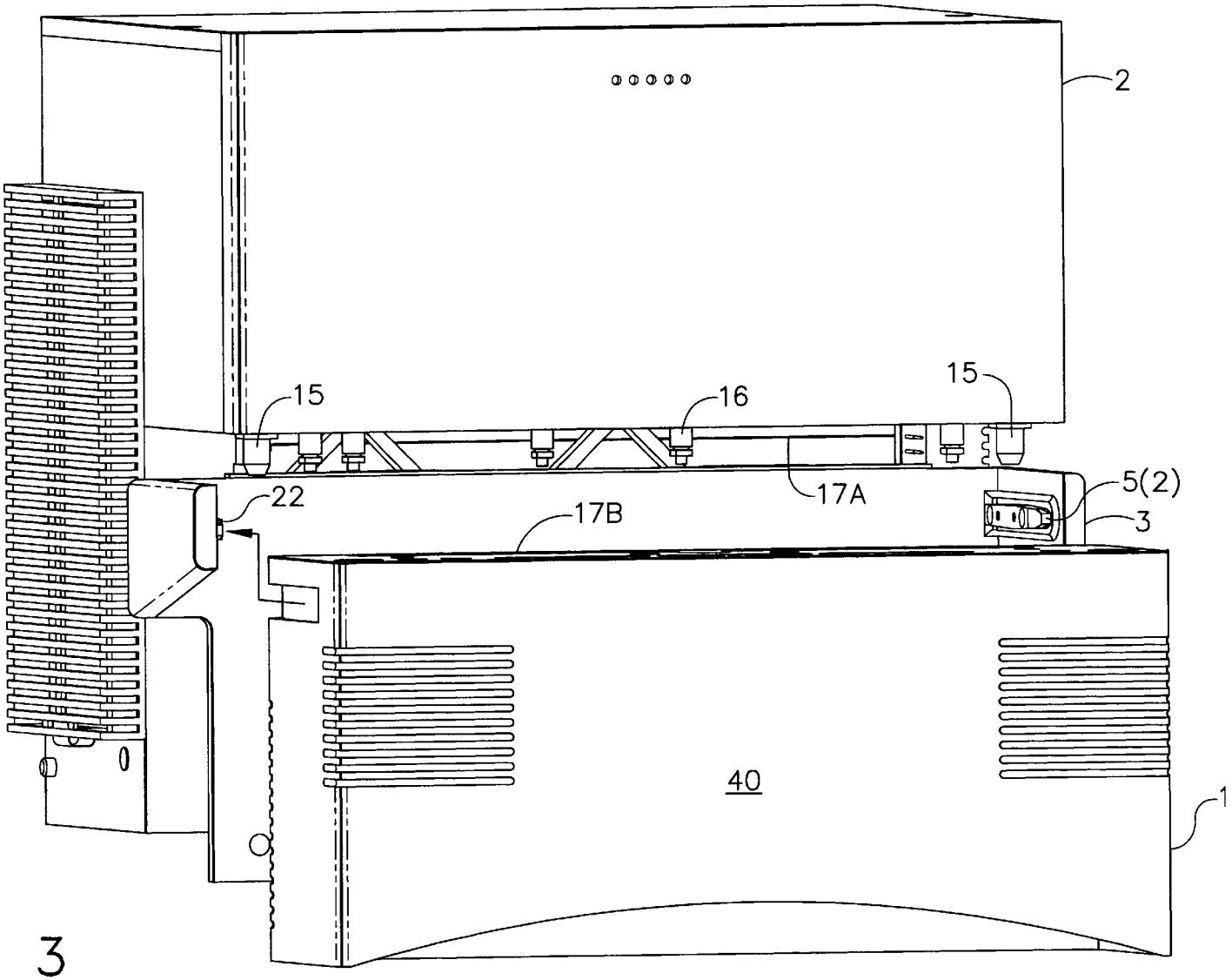
FIG. 3 is an isometric view showing the printhead separate from the printer and ready for installation.

FIG. 3 shows a detailed illustration of the printhead lift mechanism 3, which comprises a lift plate 4 having a horizontal extension on each side for mounting the two dovetails 5. The dovetails 5 cradle printhead 1 in the vertical position on lift mechanism 3 as well as approximating the final horizontal position of the printhead. openings in the cover 40 allow the dovetails to engage features on the internal frame of the printhead. The lift plate 4 is positioned and guided as it travels up or down on four bearings 6 via the guide posts 7. These guide posts ensure the desired straight line motion needed to simultaneously engage a large number of fluid and electrical connections. The lift plate 4 is moved up or down by rotating the dual start acme drive screw 8 that drives nut 9 horizontally along the screw. Pin 10 pins nut 9 to a spring loaded linkage assembly 11, with pin 12 pinning an opposite end to the lift plate 4. This nut movement pushes against the spring 11A of the linkage and in turn moves the lift plate 4 up or down. The spring 11A is pre-loaded using a screw 11B between the links. The drive screw 8 is positioned and mounted to the printhead interface controller 2 with two brackets 13 and 14 using six mounting screws. The drive screw 8 protrudes through one side of the printhead interface controller 2 and has a standard 3/16 hex socket for rotating. The printhead 1 comes to a positive stop when raised, and the frame of the printhead comes to rest on three points on the printhead interface controller. In this position, the spring loaded link 11 is compressed, taking the pre-load off screw 11B. This compression starts approximately 0.04 inches before the printhead has reached the rest position. This spring loaded mechanism ensures a constant installation force from the linkage, regardless of part tolerances.

This screw driven mechanism provides many noteworthy advantages. First, the screw drive provides a non-abrupt actuation means to engage the fluid and electrical connections. By orienting the drive screw at right angles to the translation direction of the lift mechanism and using the linkage shown, the mechanical advantage varies with position of the lift plate. When the lift plate is near the top of its travel, the linkage at close to a right angle with the drive screw, the mechanical advantage is at its highest level. As a result, lifting force on the printhead is highest when needed to for engaging the electrical connections. Conversely the translation speed slows down allowing sufficient time for the contacts to align. The high mechanical advantage also eliminates the risk that the weight of the printhead will drive the lift mechanism down, opening the fluid and electrical connections. The spring in the linkage arm provides the necessary compliance to ensure that the printhead can be driven to the vertical stops without causing damage to the printhead, printhead interface controller or the lift mechanism.

INDUSTRIAL APPLICABILITY AND ADVANTAGES

The present invention is useful in the field of ink jet printing, and has the advantage of orienting the printhead and associated electrical controls to allow for ease of removal and installation of a printhead in an ink jet printer system. An additional advantage of the present invention is that the mechanism can be oriented in any direction.

Although the present invention describes a dual start acme screw moving a spring loaded linkage to move the printhead into position, it will be obvious to those skilled in the art that the concept of the invention can be achieved in a variety of ways, without departing from the scope of the invention. For example, a hand actuated cam or other lever action may be used; or a motor driven screw or cam may be used; or a solenoid driven screw or cam may be used. It will be understood, however, that the slow moving action of the hand driven screw gives high insertion force, yet does not create safety problems such as pinching between the controller and printhead.

The invention has been described in detail with particular reference to certain preferred embodiments thereof, but it will be understood that modifications and variations can be effected within the spirit and scope of the invention.

What is claimed is:

1. In an ink jet printer having a printhead and a printhead docking station, an improvement for installing and retaining the printhead in the printhead docking station, said improvement comprising:

means to ensure straight line travel of the printhead relative to the printhead docking station;

a screw drive actuator to translate the printhead relative to the docking station; and alignment means to align the printhead and the printhead docking station so that a plurality of electrical and fluid connections can be made concurrently.

2. An ink jet printer as claimed in claim 1 wherein the improvement further comprises means to provide a consistent insertion force to the printhead.

3. An ink jet printer as claimed in claim 1 wherein the means to ensure straight line travel comprises guide posts.

4. An ink jet printer as claimed in claim 1 wherein the screw drive actuator is oriented at near right angles to a direction of translation of the printhead relative to the printhead docking station.

5. In an ink jet printer having a printhead and a printhead docking station, an improved method of installing and retaining the printhead in the printhead docking station, the method comprising the steps of:

ensuring straight line travel of the printhead relative to the printhead docking station;

using a screw drive actuator to translate the printhead relative to the docking station; and aligning the printhead and the printhead docking station so that a plurality of electrical and fluid connections can be made concurrently.

6. A method as claimed in claim 5 further comprising the step of applying a consistent insertion force to the printhead.

7. A method as claimed in claim 5 wherein the step of ensuring straight line travel further comprises the step of providing guide posts.

8. A method as claimed in claim 5 wherein the screw drive actuator is oriented at near right angles to a direction of translation of the printhead relative to the printhead docking station.

* * * * *